US008118302B2

(12) United States Patent
Elgee et al.

(10) Patent No.: US 8,118,302 B2
(45) Date of Patent: Feb. 21, 2012

(54) PASSIVE LINEAR ENCODER

(75) Inventors: Steven B. Elgee, Portland, OR (US); Steve O. Rasmussen, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 825 days.

(21) Appl. No.: 11/021,650

(22) Filed: Dec. 23, 2004

(65) Prior Publication Data

US 2005/0104948 A1 May 19, 2005

Related U.S. Application Data

(62) Division of application No. 10/281,935, filed on Oct. 28, 2002, now Pat. No. 6,860,665.

(51) Int. Cl.
*B65H 9/00* (2006.01)

(52) U.S. Cl. ..... 271/226; 399/301

(58) Field of Classification Search ..... 271/226, 271/227, 256, 198, 264; 399/165, 301, 394, 399/395, 396; 198/572, 577; 356/617; 73/865.9; 347/104, 262, 264, 153, 139; 246/136; 400/634, 400/708, 582; 101/248, 226; 358/1.2
See application file for complete search history.

(56) References Cited

U.S. PATENT DOCUMENTS 4,382,594 A * 5/1983 Weigel et al. ..... 271/272
4,530,613 A 7/1985 Horman et al.
4,565,439 A * 1/1986 Reynolds ..... 399/329
5,156,386 A 10/1992 Kitajima et al.
5,203,554 A 4/1993 Suzuki et al.
5,237,394 A 8/1993 Eaton
5,250,988 A 10/1993 Matsuura et al.
5,339,139 A 8/1994 Fullerton et al.
5,430,536 A 7/1995 Fullerton et al.
5,454,502 A * 10/1995 Hashikawa ..... 226/195
5,463,451 A 10/1995 Acquaviva et al.
5,488,464 A 1/1996 Wenthe, Jr. et al.
5,597,156 A * 1/1997 Claassen ..... 271/225
5,651,445 A * 7/1997 Stevens et al. ..... 198/447
5,833,226 A * 11/1998 Claassen ..... 270/52.16
5,855,368 A 1/1999 Middelberg et al.
5,893,526 A * 4/1999 Zwettler ..... 242/346
5,896,154 A * 4/1999 Mitani et al. ..... 347/102
5,897,259 A 4/1999 Ahn
6,007,063 A * 12/1999 Park ..... 271/273
6,048,066 A * 4/2000 Inatome ..... 352/160
6,097,919 A 8/2000 Takeuchi et al.
6,137,974 A 10/2000 Williams et al.
6,168,269 B1 1/2001 Rasmussen et al.
6,168,333 B1 1/2001 Merz et al.
6,186,498 B1 2/2001 Suzuki et al.
6,192,205 B1 2/2001 Motohashi
6,206,263 B1 3/2001 Rich et al.
6,257,692 B1 7/2001 Yokoi et al.
6,299,287 B1 10/2001 Williams et al.

(Continued)

FOREIGN PATENT DOCUMENTS

JP 02-175539 7/1990

(Continued)

*Primary Examiner* — Stefano Karmis
*Assistant Examiner* — Thomas Morrison

(57) ABSTRACT

A passive linear encoder includes a loop and a sensor. The loop is configured to engage print media and to move in concert with, and under power of, the print media. The sensor is positioned to scan indicia defined on an inner surface of the loop.

19 Claims, 7 Drawing Sheets

U.S. PATENT DOCUMENTS 6,322,069 B1 11/2001 Krucinski et al.
6,341,205 B1 1/2002 Yoshino et al.
6,385,428 B1 5/2002 Uchida et al.
6,407,678 B1 6/2002 Elgee et al.
6,487,387 B2 11/2002 Kusaba et al.
6,511,172 B2 1/2003 Tanno et al.
6,595,517 B1 * 7/2003 Tranquilla ..... 271/275
6,607,458 B2 8/2003 Downing et al.
2002/0020693 A1 * 2/2002 Otsuka et al. ..... 219/216
2002/0193191 A1 * 12/2002 Downing et al. ..... 474/103

FOREIGN PATENT DOCUMENTS

JP 5-221550 * 8/1993
JP 2001-2284 * 1/2001

* cited by examiner

PASSIVE LINEAR ENCODER

RELATED APPLICATIONS

This patent application is a divisional application of, and claims priority to, U.S. patent application Ser. No. 10/281,935, titled "Passive Linear Encoder", filed on Oct. 28, 2002, now U.S. Pat. No. 6,860,665 commonly assigned herewith, and hereby incorporated by reference.

BACKGROUND

The movement of print media within a printer may require accuracy as great as 100 (ppm) parts per million; in some cases even greater accuracy may be required. This is equivalent to a margin of error of about 0.2 mils associated with a 2 inch movement of the print media.

To achieve 100 ppm accuracy, the effective radius of printer roller shafts could be tightly controlled. For example, for a typical shaft having a 0.3 inch radius, the neutral axis, i.e. the line where the rotary velocity of the shaft and the linear velocity of the print media traveling through the paper path are equal, should be within 30 micro inches (i.e. 0.3*100 ppm), a distance which is approximately 1% of the thickness of a sheet of paper. Thus, a small deviation from the desired diameter may cause a media registration error.

Increasing the diameter of the roller is a potential solution to the issue of extremely tight tolerances required of the radius of the metering roller. However, an increased diameter can result in greater inertia during operation, which results in difficulty when printing at higher speeds.

A roller with a low contact force against the print media (such as paper) could make use of a highly frictional outer surface. However, with this approach it might be more difficult to tightly control the diameter of the roller, since the diameters of highly frictional surfaces are less easily controlled.

Alternatively, using a roller with a higher contact force against the print media may result in media deformation, which induces errors in the registration process.

SUMMARY

A passive linear encoder includes a loop and a sensor. The loop is configured to engage print media and to move in concert with, and under power of, the print media. The sensor is positioned to scan indicia defined on an inner surface of the loop.

BRIEF DESCRIPTION OF THE DRAWINGS

The same reference numbers are used throughout the drawings to reference like features and components.

DETAILED DESCRIPTION

A passive linear encoder, which measures print media movement within a printer, copier or other hard copy output device, includes a loop and a sensor. The loop is configured to engage print media and to move in concert with, and under power of, the print media. The sensor is positioned to scan indicia defined on an inner surface of the loop.

Figure 1:
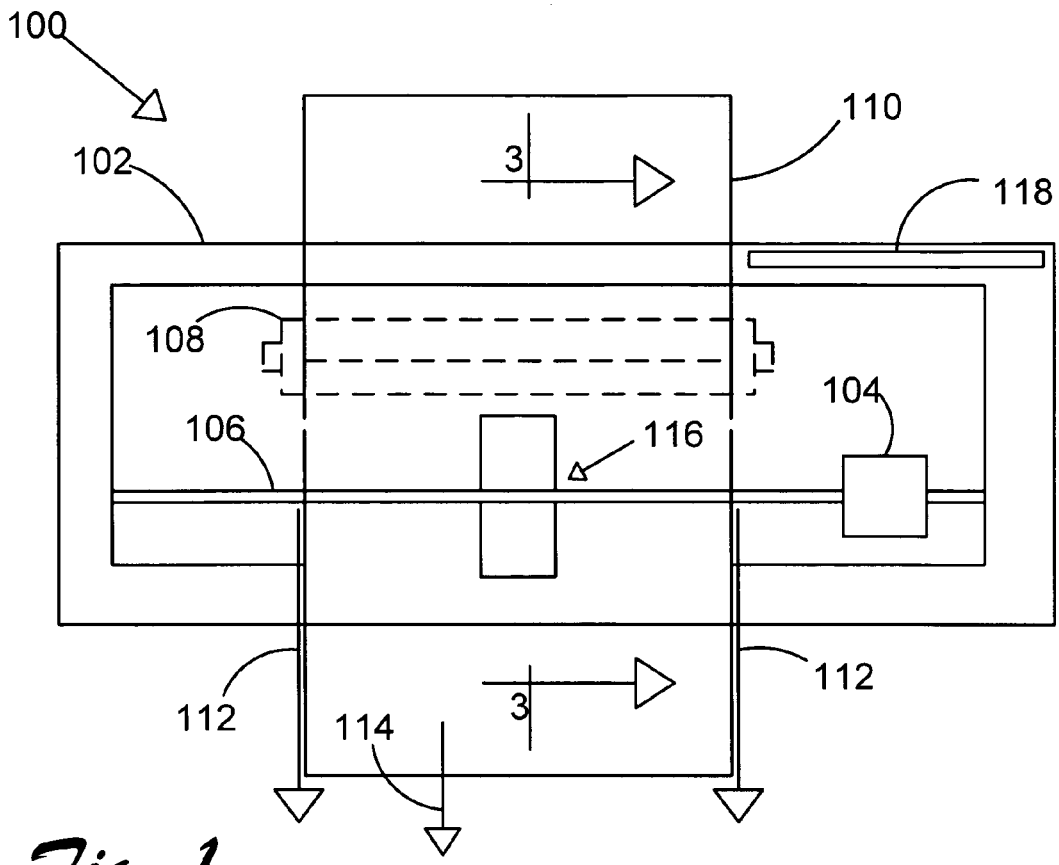
FIG. 1 is a top plan view of a printer having an implementation of a passive linear encoder.

FIG. 1 shows an exemplary implementation 100 of a printer 102 having an exemplary passive linear encoder. The printer 102 may be based on any type of technology, such as that found in ink jet and laser printers. In the exemplary implementation of FIG. 1, the printer is based on ink jet technology. A printhead 104 moves along a carriage rod 106. A print media advancement mechanism 108 may be based on one or more rollers, which drive print media 110, such as paper, envelopes or other material, through a media or paper path 112. The direction of media movement 114 indicates the direction by which print media moves during the course of printing.

Print media registration involves maintaining knowledge of the location of the print media (e.g. sheets of paper and envelopes) as the print media moves through the paper path 112 in the direction of media movement 114. As will be seen in greater detail below, a passive linear encoder 116 and registration decoder electronics 118 obtain and use information on print media location.

Figure 2:
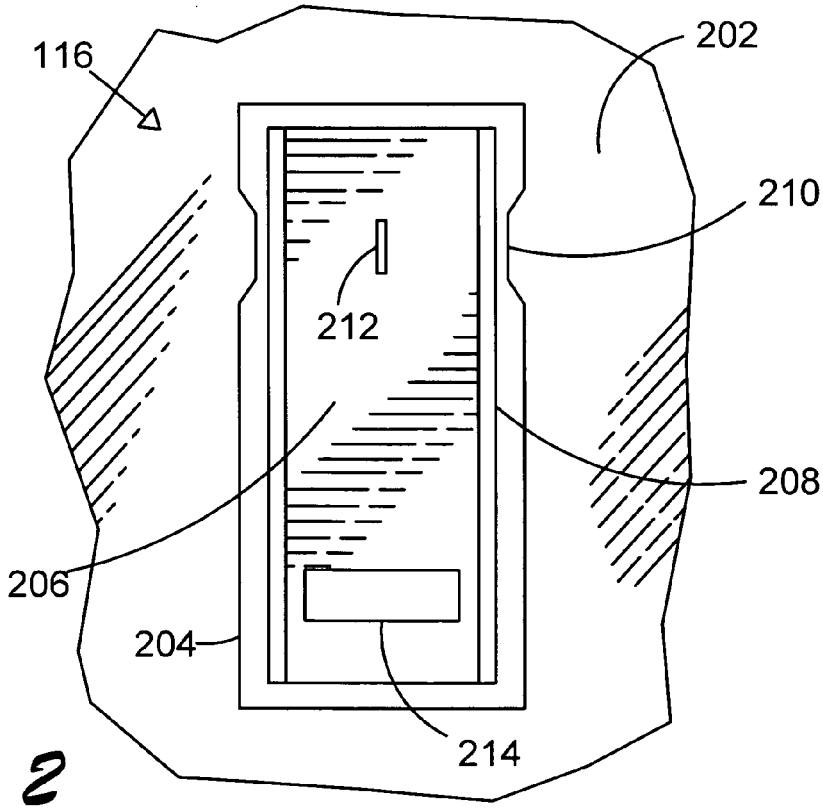
FIG. 2 is an enlarged top plan view of the passive loop portion of the implementation of the passive linear encoder, as viewed through the registration window defined in a deck portion of the printer.

FIG. 2 is an enlarged view of a portion of the sensor/encoder 116 of the print media registration apparatus, taken from the same perspective as seen in FIG. 1. Print media 110, such as the sheet of paper seen in FIG. 1, slides along the upper deck 202 of the printer 102 as it moves through the paper path 112. A registration window 204 is an opening defined in the upper deck 202. The registration window 204 may be rectangular, having the elongated direction parallel to the direction of media movement 114 through the paper path 112.

As seen from above, a passive loop 206 is carried by a guide 208. The passive loop 206 is configured to engage the print media 110 in frictional contact through the registration window 204. Motion of the print media 110 drives the passive loop 206 to rotate about the guide 208, as will be seen in greater detail, below.

Two guide elements 210 are separated by a space that is incrementally greater than the width of the passive loop 206. Accordingly, as the passive loop 206 rotates on the guide 208, the guide elements 210 assist in keeping the passive loop 206 correctly oriented on the guide 208.

Two biasing elements, a star wheel 212 and a shim 214 are configured to provide a slight force against the print media 110, which increases the coefficient of friction between the print media 110 and the outer surface of the passive loop 206. In the implementation seen in FIG. 2, paper (not shown to avoid obscuring the passive loop) moving over the deck surface 202 and through the paper path 112 would move between the passive loop 206 and the biasing elements. The biasing elements would apply a slight bias to the print media 110, thereby increasing the frictional force between the print media 110 and the passive loop 206. As a result, the friction between the print media 110 and the passive loop 206 is static friction, rather than kinetic friction; accordingly, the passive loop 206 moves in concert with the print media 110, as the print media 110 moves through the paper path 112.

Figure 3:
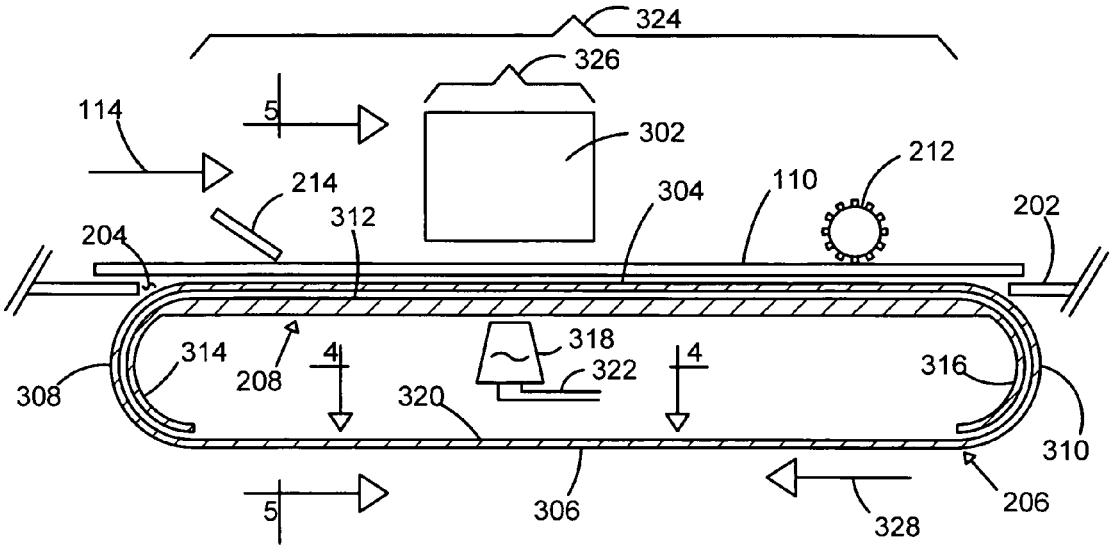
FIG. 3 is a cross-sectional view of the implementation of the passive linear encoder, taken along the 3-3 lines of FIG. 1.

FIG. 3 shows a cross-sectional view of the passive loop 206. The passive loop 206 is configured to revolve about the guide 208 as paper or other print media 110 moves through the paper path 112 adjacent to a printhead 302. The movement of the passive loop 206 is a result of a high coefficient of static friction between the media 110 and the passive loop 206 and a low coefficient of kinetic friction between the passive loop 206 and the guide 208. Accordingly, a first component 304 of the passive loop 206 is configured and oriented for movement in the direction 114 of, and at the speed of, print media movement. The first component 304 is generally framed within the registration window or opening 204 within the upper deck 202 of the printer 102. A second component 306 is configured and oriented for movement in a direction 328 opposed to the media movement. Upstream and downstream directionally translational components 308, 310 allow the passive loop 206 to rotate about the guide 208.

The guide 208 includes an upper deck 312, which supports the first component 304 of the passive loop 206 within the registration window 204 defined in the printer deck 202. Upstream and downstream turnarounds 314, 316 support portions 308, 310 of the passive loop 206.

A sensor 318 is configured to detect the passage of indicia, such as a "jail bar" pattern on the inside surface 320 of the passive loop 206, typically with an accuracy of better than 100 ppm. The sensor 318 communicates with the decoder electronics 118 (seen in FIG. 1) over wiring 322. A preferred sensor 318 observes the jail bar pattern 402 having alternating light and dark bars 404, 406 (seen in FIG. 4 from the orientation of the 4-4 lines of FIG. 3) and produces an analog signal having voltage which varies as a sine wave or a similar signal.

In the implementation of FIG. 3, the length 324 of the first component 304 of the passive loop 206 is greater than the distance 326 by which the print media 110 is incrementally advanced, which is typically related to the size of the printhead 302 used in an ink jet application. In an alternative implementation, the relative lengths of distances 234, 326 could be reversed or altered.

Two biasing elements bias the print media 110 against the passive loop 206, thereby maintaining contact between them, and maintaining a static (as opposed to a kinetic) frictional condition. The star wheel 212 is used downstream, since it is able to apply bias without degrading print quality. The shim 214 is used upstream, prior to application of the ink, since its design might result in ink smearing.

Figure 5:
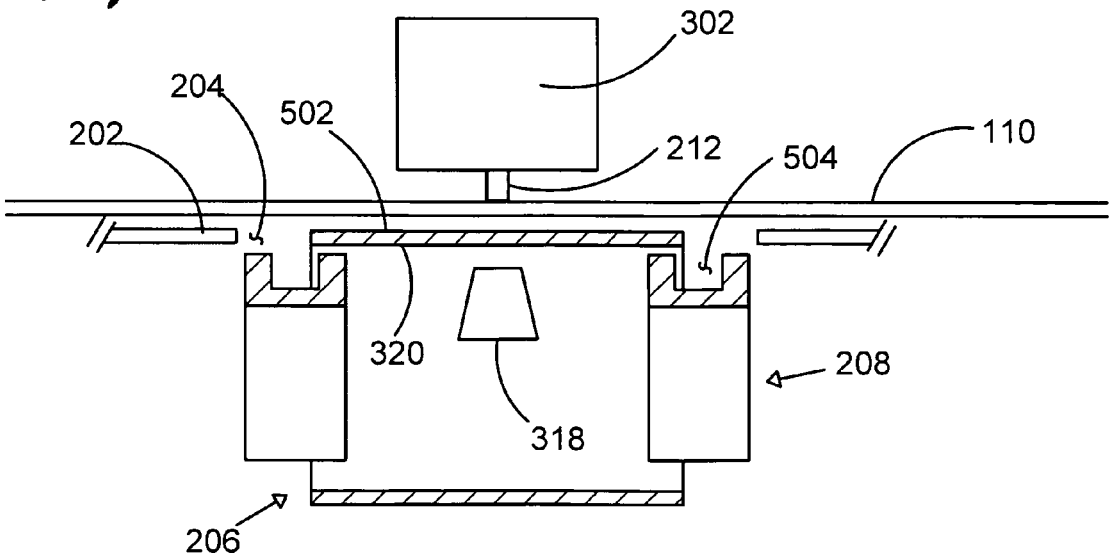
FIG. 5 is a cross-sectional view of the implementation of the passive linear encoder of FIG. 3, taken along the 5-5 lines of FIG. 3.

FIG. 5 shows a cross-sectional view of the print media registration apparatus of FIG. 3, taken along the 5-5 lines of FIG. 3. The print media or paper 110 is carried on the deck 202 of the printer 102. The registration window 204, defined in the deck 202, allows a portion of the passive loop 206 to extend through the upper deck 202, and to contact the media 110.

The printhead 302 is adjacent to the media 110. The star wheel 212 or similar biasing element is partially obscured by the printhead 302, and provides a slight bias against the media 110 to maintain a static frictional connection between the media 110 and the outer surface 502 of the passive loop 206 and the lower surface of the media 110. For purposes of illustration only, FIG. 5 shows these elements slightly separated, thereby revealing that distinct structures exist.

The outer surface 502 of the passive loop 206 is highly frictional, having a high coefficient of friction that is well-suited to maintain a static frictional bond with the lower surface of the media 110 as the media moves through the print path 112. Accordingly, the media 110 will drive the passive loop 206 to revolve about the guide 208.

The inner surface 320 of the passive loop 206 is very smooth, having a very low coefficient of friction that is well-suited to result in very little drag or energy loss due to kinetic friction as the inside surface 320 contacts the guide 208. As seen above, the jail bar pattern 402 of FIG. 4, or an alternative pattern, is defined on the inner surface 320. The sensor 318 is positioned to monitor movement of the pattern during operation.

Optional gutters 504, defined in the guide 208, allow paper fibers or similar foreign material to accumulate without resulting in print quality degradation.

Figure 6:
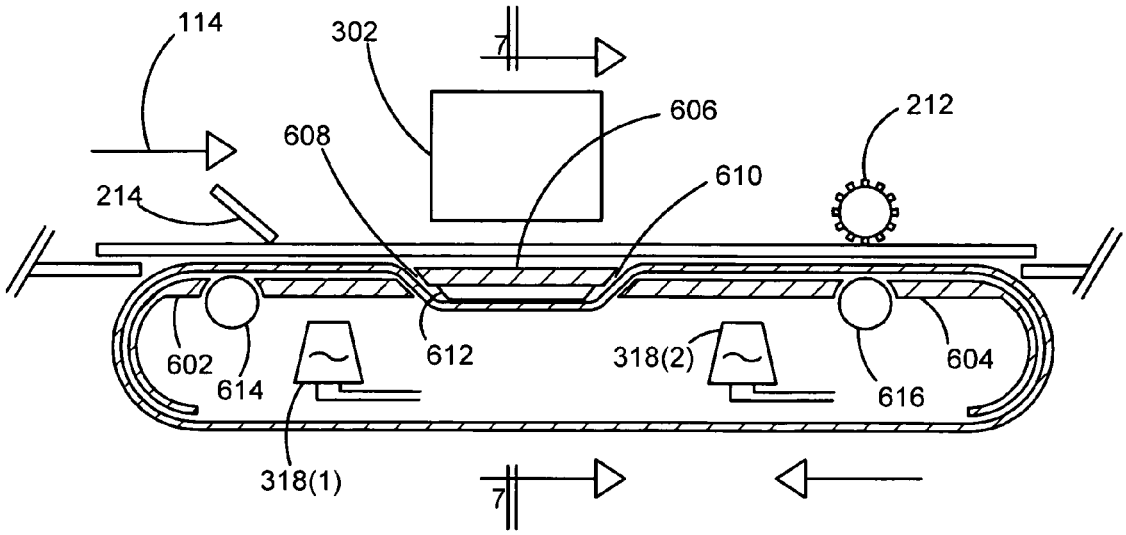
FIG. 6 is a cross-sectional view of a second implementation of the passive linear encoder, taken from a perspective similar to that of FIG. 3.

The implementation seen in FIG. 6 differs from that seen in FIG. 3 in that the guide is compound. The compound guide is associated with a platen, which can result in higher print quality in some circumstances. The compound guide provides an upstream segment 602 and a downstream segment 604. The platen 606 is carried between the segments. An upstream slot 608 and a downstream slot 610 are defined between the platen 606 and the upstream 602 and downstream 604 segments, respectively. The direction of print media movement 114 determines the orientation of upstream and downstream. The passive loop 206 is configured to pass through the upstream and downstream slots 608, 610, and thereby pass on the far side 612 of the platen 606, i.e. the side of the platen 606 opposite the printhead 302.

Due to the non-linear configuration of the upper portion of the passive loop 206 in the area of the platen 606, the sensor 318 may be more accurate in an upstream or a downstream location. A representative upstream location is illustrated by sensor 318(1) and a representative downstream location is illustrated by sensor 318(2). In some implementations, two sensors may be used, including an upstream sensor 318(1) and a downstream sensor 318(2). In such an application, data originating from the upstream sensor 318(1) may initially be more accurate than data originating from the downstream sensor 318(2) as the print media 110 approaches the printhead 302. Later, as the print media 110 begins to move away from the printhead 302, data from the downstream sensor 318(2) may be more accurate. Accordingly, data from both sensors 318(1), 318(2) may be evaluated, to obtain greater sensing accuracy.

Optionally, the shim 214 and the star wheel 212 may be aligned with rollers 614, 616, respectively. The rollers 614, 616 reduce friction between the passive loop 206 and compound guide segments 602, 604, respectively. Accordingly, the shim 214 and star wheel 212 are able to increase friction between the print media 110 and the passive loop 206, while the rollers 614, 616 prevent a similar increase in friction between the passive loop 206 and the compound guide segments 602, 604.

Figure 7:
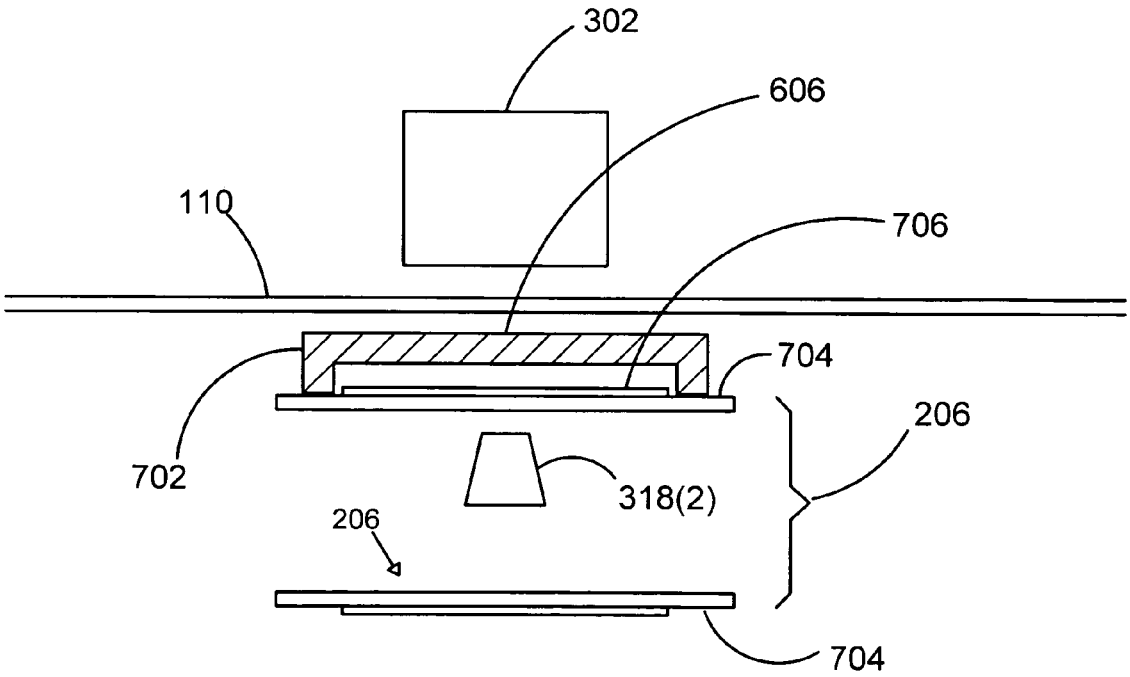
FIG. 7 is a thin-section view of the second implementation of the passive linear encoder of FIG. 6, taken from a perspective similar to that of FIG. 5.

FIG. 7 shows a thin-section view of the print media registration apparatus of FIG. 6, taken from a perspective similar to that of FIG. 5. The platen 606 includes two rails 702 on the side of the platen opposite the printhead 302, i.e. the side of the platen 606 oriented toward the passive loop 206. The passive loop 206 includes peripherally defined rims 704 configured to ride on the rails 702. The peripheral rims 704 have surfaces with very low frictional coefficients, which slide easily on the rails 702. A frictional surface 706, defined between the rims 704, has a high coefficient of friction, and is therefore suited for formation of a static frictional bond with the print media 110.

Figure 8:
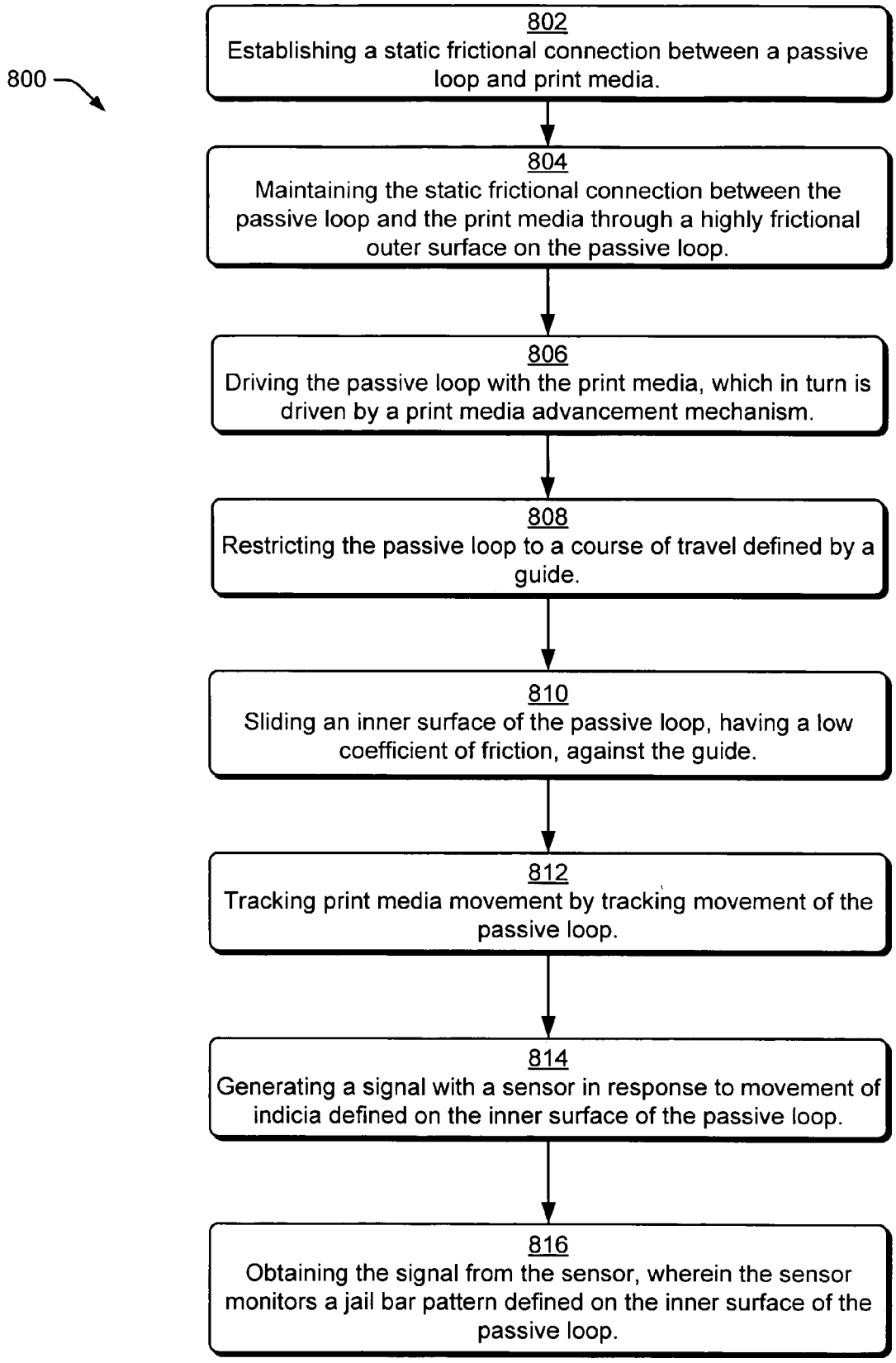
FIG. 8 is a flow chart illustrating a further exemplary implementation of print media registration using an implementation of the passive linear encoder.

The flow chart of FIG. 8 illustrates an implementation of an exemplary method 800 for print media registration using a passive linear encoder 116. The elements of the method may be performed by any desired means, such as by the movement of mechanical parts initiated and controlled through the execution of processor-readable instructions defined on a processor-readable media, such as a disk, a ROM or other memory device. Also, actions described in any block may be performed in parallel with actions described in other blocks, may occur in an alternate order, or may be distributed in a manner which associates actions with more than one other block.

At block 802, a static frictional connection is established between the passive loop 206 and print media 110. For example, as seen in FIG. 3, a first component 304 of the passive loop 206 is in contact with the media 110.

At block 804, the static frictional connection is maintained between the passive loop 206 and the print media 110 through a highly frictional outer surface 502 on the passive loop 206. Because the outside surface 502 of the passive loop 206 has a high coefficient of friction, the bond established with the print media 110 is through static friction, rather than through kinetic friction.

At block 806, the print media 110 drives the passive loop 206, causing the passive loop 206 to rotate about the guide 208. The print media 110 is in turn driven by the print media advancement mechanism 108.

At block 808, the passive loop 206 is restricted to a course of travel defined by a guide 208. Referring to FIG. 3, it can be seen that as the media 110 moves from left to right, according to direction 114, the passive loop 206 moves about the guide 208 in a clockwise manner.

At block 810, the inner surface 320 of the passive loop 206, having a low coefficient of friction, slides against the guide 208. The inner surface 320 maybe covered with a material, such as TEFLON®, which results in a low coefficient of kinetic friction as the inner surface 320 of the passive loop 206 is slid against the guide 208.

At block 812, print media 110 movement is tracked by tracking movement of the passive loop 206. Since the passive loop 206 moves in concert with the movement of the print media 110, movement of the print media 110 can be tracked by tracking movement of the passive loop 206.

At block 814, a signal is generated by a sensor 318 in response to movement of indicia 402 defined on an inner surface 320 of the passive loop 206. As seen, for example, in FIG. 3, a sensor 318 is configured to generate a signal in response to movement of indicia 402 defined on the inner surface 320 of the passive loop 206.

Figure 4:
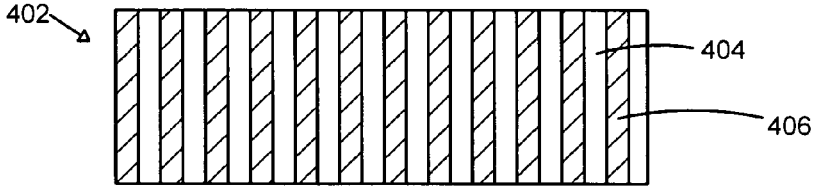
FIG. 4 is an exemplary view of the inner surface of the passive loop, taken along the 4-4 lines of FIG. 3.

At block 816, the signal from the sensor 318 is obtained, wherein the sensor 318 monitors a jail bar pattern 402, such as that seen in FIG. 4 comprising alternating light 404 and dark 406 bars that is defined on the inner surface 320 of the passive loop 206.

Figure 9:
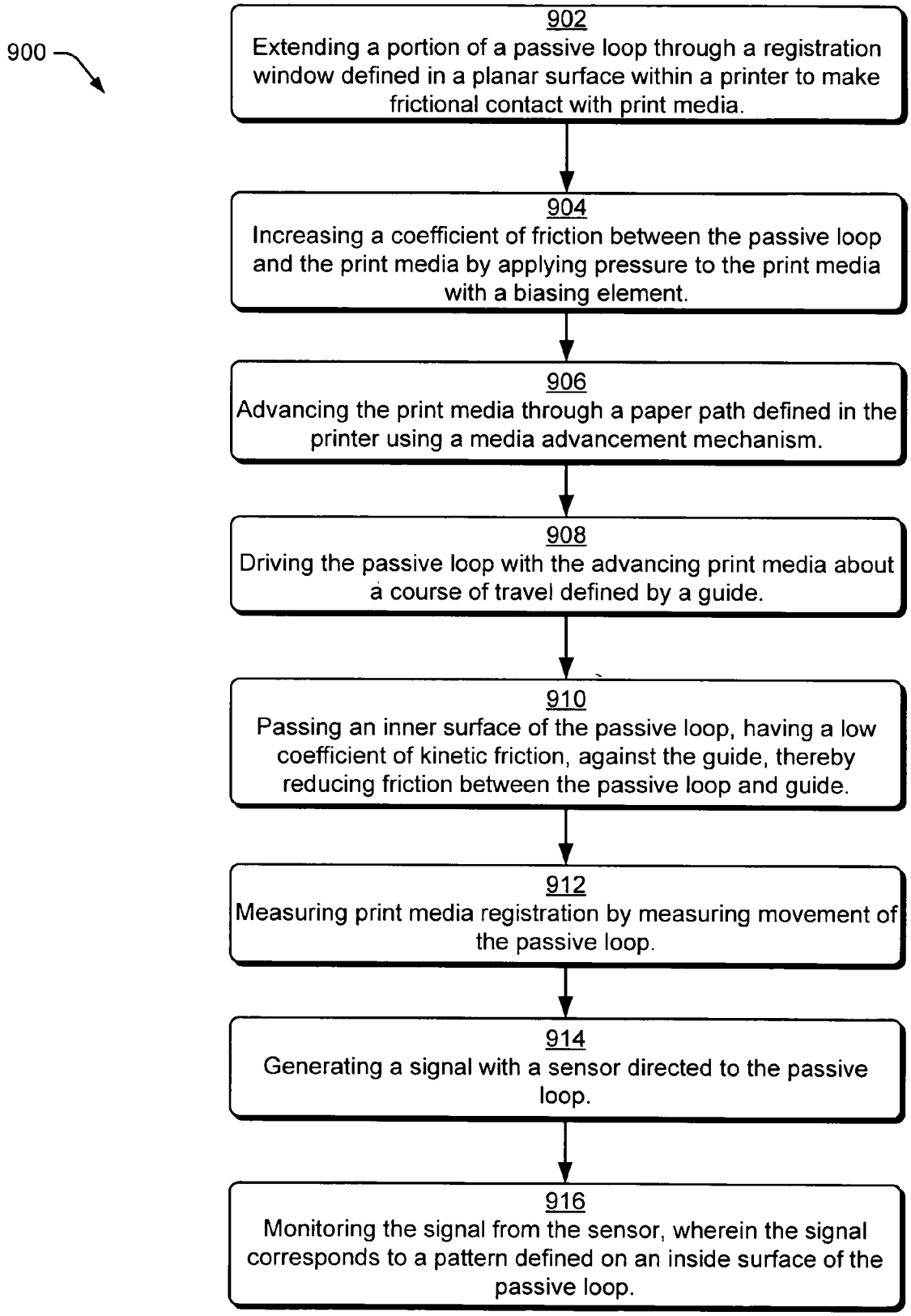
FIG. 9 is a flow chart illustrating a further exemplary implementation of a print media registration using an implementation of the passive linear encoder.

The flow chart of FIG. 9 illustrates an implementation of an exemplary method 900 for performing print media registration using a passive linear encoder 116 and thereby tracking print media movement. The elements of the method may be performed by any desired means, such as by the movement of mechanical parts initiated and controlled through the execution of processor-readable instructions defined on a processor-readable media, such as a disk, a ROM or other memory device. Also, actions described in any block may be performed in parallel with actions described in other blocks, may occur in an alternate order, or may be distributed in a manner which associates actions with more than one other block.

At block 902, a portion of a passive loop 206 that extends through a registration window 204 defined in a planar surface 202 within a printer 102 makes frictional contact with print media 110. FIGS. 2 and 3 illustrate how the passive loop 206 makes contact with the print media 110 through the registration window 204.

At block 904, a coefficient of friction is increased between the passive loop 206 and the print media 110 by applying pressure to the print media 110 with a biasing element. The biasing element may be a star wheel 212, a shim 214 or other element such as a pinch roller, as desired.

At block 906, the print media 110 is advanced through a paper path 112 defined in the printer 102 using a media advancement mechanism 108. For example, rollers may be used to drive the print media 110.

At block 908, the passive loop 206 is driven by advancing the print media 110 about a course of travel defined by a guide 208. Referring particularly to FIG. 3 or 6, it can be seen how frictional contact between advancing print media 110 and the passive loop 206 drives the passive loop 206 about the guide 208.

At block 910, an inner surface 320 of the passive loop 206, having a low coefficient of kinetic friction, is passed against the guide 208, thereby reducing friction between the passive loop 206 and the guide 208.

At block 912, print media registration is measured by measuring movement of the passive loop 206.

At block 914, a signal is generated by a sensor 318, which is directed to detect indicia, such as alternating light and dark patterns 402, on the passive loop 206.

At block 916, the signal from the sensor 318, corresponding to the pattern defined on an inner surface of the passive loop 206, is monitored.

Figure 10:
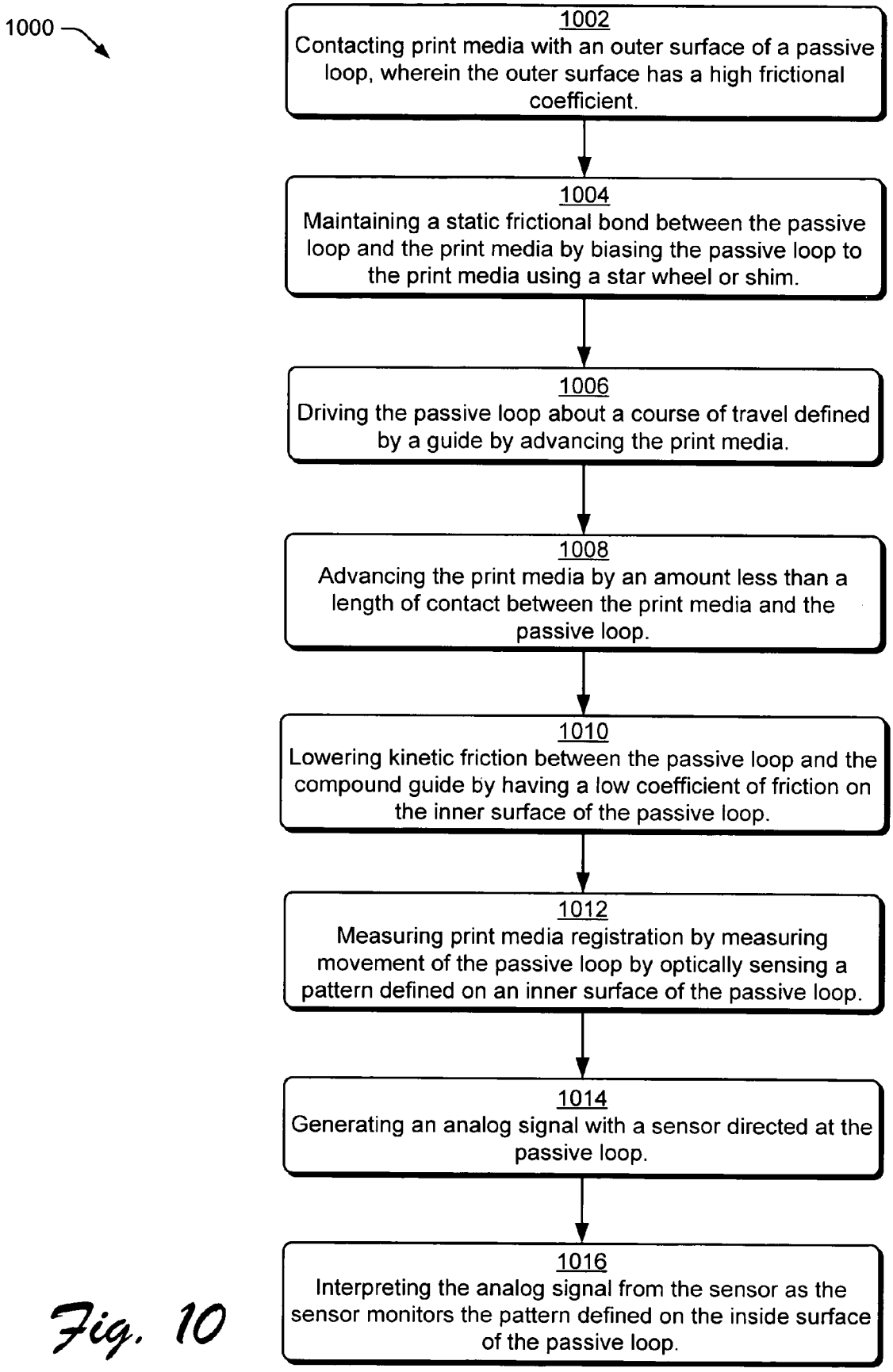
FIG. 10 is a flow chart illustrating a further exemplary implementation of print media registration using an implementation of the passive linear encoder.

The flow chart of FIG. 10 illustrates an implementation of an exemplary method 1000 for print media registration using a passive linear encoder 116. The elements of the method may be performed by any desired means, such as by the movement of mechanical parts initiated and controlled through the execution of processor-readable instructions defined on a processor-readable media, such as a disk, a ROM or other memory device. Also, actions described in any block may be performed in parallel with actions described in other blocks, may occur in an alternate order, or may be distributed in a manner which associates actions with more than one other block.

At block 1002, print media 110 contacts an outer surface 502 of a passive loop 206. The outer surface 520 of the passive loop 206 has a highly frictional coefficient, which results in a static frictional bond between the passive loop 206 and the media 110.

At block 1004, a static frictional bond is maintained between the passive loop 206 and the print media 110 by biasing the passive loop 206 to the print media 110 using a biasing element. As seen in FIGS. 3 and 6, the biasing elements may include a star wheel 212, a shim 214, or similar element that can apply a slight bias to the print media 110, thereby resulting in a greater frictional coefficient between the print media 110 and the passive loop 206.

At block 1006, the passive loop 206 is driven about a course of travel defined by a guide 208 by advancing the print media 110.

At block 1008, the print media 110 is advanced by an amount less than a length of contact between the print media and the passive loop. For example, as seen in FIG. 3, the distance of print media advancement 326 is less than the distance 324 associated with the contact between the print media 110 and the passive loop 206.

At block 1010, kinetic friction between the passive loop 206 and the guide 208 is lowered because the inner surface 320 on the passive loop 206 is configured to have a low coefficient of friction. Alternatively, the guide 208 may be constructed of a low-friction material, or both the inner surface 320 and the guide 208 may be made of low-friction material.

At block 1012, print media registration is measured by measuring movement of the passive loop 208 by optically sensing a pattern 402 defined on an inner surface 320 of the passive loop 206.

At block 1014, a signal, typically analog but alternatively digital, is generated by a sensor 318 directed at the passive loop 206. In the exemplary implementation of FIGS. 3-5, the sensor 318 is optical, and is therefore directed at indicia 402 such as that illustrate in FIG. 4. Where indicated or desired, an alternative sensor based on an alternative technology (e.g. a magnetically operated sensor) could be substituted.

At block 1016, the analog signal from the sensor 318 is interpreted as the sensor monitors the pattern 402 defined on the inner surface 320 of the passive loop 206. The signal may then be interpreted by decoder electronics 118.

Figure 11:
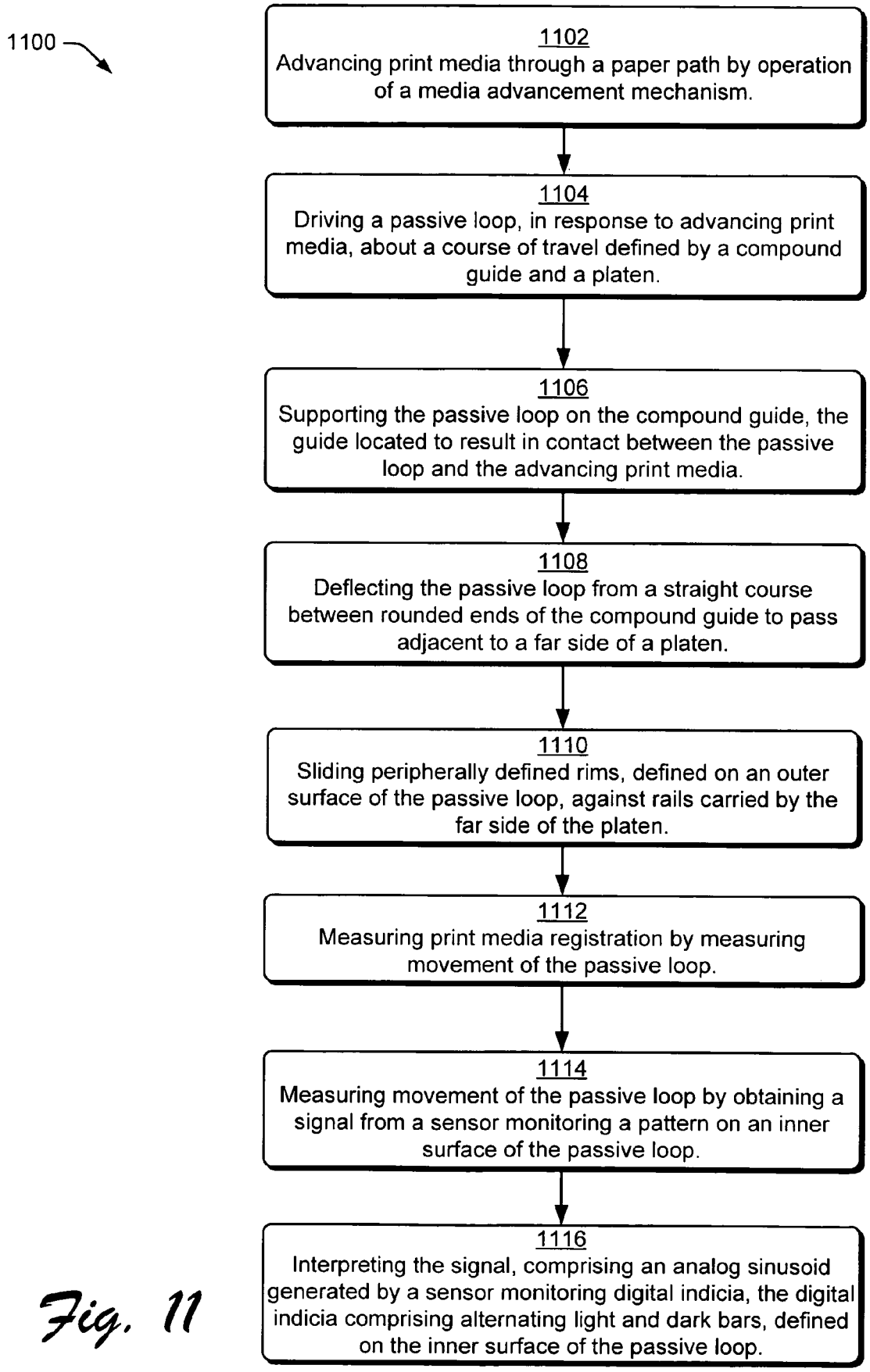
FIG. 11 is a flow chart illustrating a further exemplary implementation of print media registration using an implementation of the passive linear encoder, wherein a compound guide is employed.

The flow chart of FIG. 11 illustrates an implementation of an exemplary method 1100 for print media registration using a passive linear encoder 116 wherein a compound guide is employed. The elements of the method may be performed by any desired means, such as by the movement of mechanical parts initiated and controlled through the execution of processor-readable instructions defined on a processor-readable media, such as a disk, a ROM or other memory device. Also, actions described in any block may be performed in parallel with actions described in other blocks, may occur in an alternate order, or may be distributed in a manner which associates actions with more than one other block.

At block 1102, print media 110 is advanced through a paper path 112 by operation of a media advancement mechanism 108.

At block 1104, a passive loop 206 is driven, in response to advancing print media 110, about a course of travel defined by a compound guide 602, 604 and a platen 606.

At block 1106, the passive loop 206 is supported on the compound guide 602, 604 in a location configured to result in contact between the passive loop 206 and the advancing print media 110.

At block 1108, the passive loop 206 is deflected from a straight course between rounded ends 314, 316 of the compound guide 602, 604 to pass adjacent to a platen's far side. Referring particularly to FIG. 6, it can be seen that the platen 606 is carried between the upstream and downstream segments 602, 604 of the compound guide. Moreover, it can be seen that the passive loop 206 is deflected from the straight course seen in FIG. 3, passing through openings 608, 610 in a manner which allows the passive loop 206 to pass adjacent to the platen's far side (i.e. the side opposite the printhead 302).

At block, 1110, peripherally defined rims 704 (as seem in FIG. 7), which are defined on an outer surface 502 of the passive loop 206, slide against rails 702 carried by a far side of a platen 606.

At block 1112, print media registration is measured by measuring movement of the passive loop 206. Since the passive loop 206 moves in concert with the print media 110, measurement of the movement of the passive loop 206 reveals the movement of the print media 110.

At block 1114, movement of the passive loop 206 is measured by obtaining a signal from a sensor 318, wherein the sensor 318 monitors a pattern 402 on an inner surface 320 of the passive loop 206.

At block 1116, the signal, comprising an analog sinusoid generated by a sensor 318 monitoring digital indicia 402, is interpreted. As seen in FIG. 4, the digital indicia 402 may include alternating light 404 and dark 406 bars, defined on the inner surface 320 of the passive loop 206. Alternatively, other further optical, magnetic or alternate technology patterns or indicia may be employed to result in signal generation and interpretation. Interpretation of the signal results in real-time knowledge of the location of the media, which is essential for performance of the printing process.

Although the disclosure has been described in language specific to structural features and/or methodological steps, it is to be understood that the appended claims are not limited to the specific features or steps described. Rather, the specific features and steps are exemplary forms of implementing this disclosure.

Additionally, while one or more methods have been disclosed by means of flow charts and text associated with the blocks, it is to be understood that the blocks do not necessarily have to be performed in the order in which they were presented, and that an alternative order may result in similar advantages.

The invention claimed is:

1. A print registration apparatus, comprising:

means for contacting print media with an outer surface of a passive loop;

means for driving the passive loop about a course of travel defined by a guide by advancing the print media through a printer; and means for measuring print media registration during printing by measuring movement of the passive loop by optically sensing a pattern defined on an inner surface of the passive loop.

2. The print registration apparatus of claim 1, additionally comprising:

means for maintaining a static frictional bond between the passive loop and the print media by biasing the passive loop to the print media using a biasing element.

3. The print registration apparatus of claim 1, additionally comprising:

means for advancing the print media by an amount less than a length of contact between the print media and the passive loop.

4. The print registration apparatus of claim 1, wherein the outer surface of the passive loop has a first frictional coefficient and wherein an inner surface of the passive loop has a second frictional coefficient less than the first frictional coefficient.

5. The print registration apparatus of claim 1, wherein the guide includes a stationary guide and wherein the means for measuring optically senses the pattern through an opening in the guide.

6. The print registration apparatus of claim 1 further comprising a stationary guide, wherein the passive loop is configured to slide relative to and along the guide.

7. A print media movement apparatus, comprising:

a loop, wherein the loop follows a course of travel defined by a guide and is configured to be connected to print media by static friction;

a print media advancement mechanism, wherein the print media advancement mechanism moves the print media and also the loop is moved through the course of travel relative to the print media due to the static friction between the loop and the print media; and a tracking mechanism, wherein the tracking mechanism tracks the print media by tracking the movement of the loop, wherein an inner surface of the loop has a low coefficient of friction to slide along the guide.

8. The print media movement apparatus of claim 7, wherein the tracking mechanism tracks the movement of the loop with a sensor that monitors a pattern defined on the inner surface of the loop.

9. The print media movement apparatus of claim 7, wherein the tracking mechanism generates a signal in response to tracking the movement of a pattern defined on the inner surface of the loop wherein the signal from the tracking mechanism is monitored to measure movement of the loop and wherein movement of the print media is measured by the movement of the loop that has been measured by the tracking mechanism.

10. The print media movement apparatus of claim 7, wherein the loop has an outer surface having a first frictional coefficient and an inner surface having a second frictional coefficient less than the first frictional coefficient.

11. The print media movement apparatus of claim 7, wherein the guide is stationary and includes an opening and wherein the tracking mechanism includes a sensor configured to sense an inner surface of the loop through the opening in the guide.

12. An apparatus comprising:

a print head;

a guide;

a passive loop having an outer surface arranged to contact a print media being driven across the loop and opposite the print head while in contact with the loop and an inner surface in contact with the guide; and a sensor configured to sense movement of the inner surface of the loop.

13. The apparatus of claim 12, wherein the outer surface has a first frictional coefficient and wherein the inner surface has a second frictional coefficient less than the first frictional coefficient.

14. The apparatus of claim 12, wherein the inner surface is configured to slide relative to and along the guide.

15. The apparatus of claim 12, wherein the guide is stationary and includes an opening and wherein the sensor is configured to sense the inner surface of the loop through the opening.

16. The apparatus of claim 12 further comprising a print head opposite the loop on an opposite side of the loop as the sensor.

17. The apparatus of claim 16 further comprising a platen opposite the print head and sandwiched between the loop and the print head.

18. The apparatus of claim 12 further comprising gutters proximate opposite edges of the loop.

19. The apparatus of claim 12 further comprising a star wheel opposite the loop and configured to urge print media towards the loop.

* * * * *